US011054760B2

(12) United States Patent
Tanimoto et al.

(10) Patent No.: US 11,054,760 B2
(45) Date of Patent: Jul. 6, 2021

(54) IMAGE FORMING APPARATUS

(71) Applicant: TOSHIBA TEC KABUSHIKI KAISHA, Tokyo (JP)

(72) Inventors: Koji Tanimoto, Tagata Shizuoka (JP); Takeshi Watanabe, Yokohama Kanagawa (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/568,653

(22) Filed: Sep. 12, 2019

(65) Prior Publication Data

US 2021/0080853 A1 Mar. 18, 2021

(51) Int. Cl.

| | |
|---|---|
| ***G03G 15/04*** | (2006.01) |
| ***G03G 15/08*** | (2006.01) |
| ***B41J 2/45*** | (2006.01) |
| ***G03G 15/28*** | (2006.01) |

(52) U.S. Cl.

CPC ..... *G03G 15/04054* (2013.01); *B41J 2/451* (2013.01); *G03G 15/0808* (2013.01); *G03G 15/286* (2013.01); *G03G 2215/0409* (2013.01); *G03G 2215/2058* (2013.01)

(58) Field of Classification Search

CPC ..... G03G 15/04054; G03G 15/286; G03G 15/0808; G03G 2215/0409; G03G 2215/2058; B41J 2/451

USPC ..... 347/245

See application file for complete search history.

(56) References Cited

U.S. PATENT DOCUMENTS

| | | | | |
|---|---|---|---|---|
| 2002/0149664 | A1 | 10/2002 | Nagamine et al. | |
| 2007/0158692 | A1 | 7/2007 | Nakayama et al. | |
| 2007/0236554 | A1 | 10/2007 | Koike | |
| 2008/0153023 | A1* | 6/2008 | Yamazaki | G03G 9/0819 430/108.11 |
| 2011/0069133 | A1* | 3/2011 | Sowa | G03G 21/1666 347/224 |
| 2017/0289384 | A1* | 10/2017 | Suzuki | H04N 1/23 |
| 2019/0268498 | A1 | 8/2019 | Tanimoto | |

* cited by examiner

*Primary Examiner* — Huan H Tran
*Assistant Examiner* — Alexander D Shenderov
(74) *Attorney, Agent, or Firm* — Foley & Lardner LLP

(57) ABSTRACT

According to one embodiment, an image forming apparatus includes a light emitting element array, a photosensitive member, a transparent member, a gap spacer, and a biasing member. The light emitting element array includes a plurality of light emitting elements. The photosensitive member forms a latent image by being exposed by light emitted from the light emitting element array. The transparent member is positioned between the photosensitive member and the light emitting element array. The transparent member has a relative position fixed with respect to the light emitting element array, and transmits the light emitted from the light emitting element array. The gap spacer keeps a distance between the photosensitive member and the transparent member constant. The biasing member biases the transparent member toward the photosensitive member.

20 Claims, 11 Drawing Sheets

IMAGE FORMING APPARATUS

FIELD

Embodiments described herein relate generally to an image forming apparatus.

BACKGROUND

An image forming apparatus such as a printer, a copying machine, and a multi-functional peripheral (MFP) using an electrophotographic process is known. Two systems referred to as a laser scan unit (LSU) and a print head (a solid head) are known as an exposure device (an exposure unit) of the image forming apparatuses. In the laser scan unit, a photosensitive drum is exposed by a laser beam scanned by a polygon mirror. In the print head, the photosensitive drum is exposed by light outputted from a plurality of light emitting elements such as a light emitting diode (LED).

Since the laser scan unit is required to rotate the polygon mirror at a high speed, much energy is consumed when forming an image, and an operation sound is generated. Since a mechanism for scanning the laser beam and a lens group for forming an image of a scanning beam on the photosensitive drum are required, the laser scan unit tends to become a large unit shape.

Since one print head has a structure in which the light emitted from the plurality of light emitting elements is formed with an image on the photosensitive drum by using a small lens connecting an erect image referred to as a rod lens array, the miniaturization thereof can be achieved. Since there is no movable unit, energy consumption is small and the exposure unit is quiet. In addition to one using the LED (one in which LED chips are arranged), one using an organic EL (organic light emitting diode (OLED)) is also developed as the print head.

The light emitting element of the print head is required to be disposed with high positional accuracy with respect to the photosensitive drum as resolution is improved.

DETAILED DESCRIPTION

In general, according to one embodiment, an image forming apparatus includes a light emitting element array, a photosensitive member, a transparent member, a gap spacer, and a biasing member. The light emitting element array includes a plurality of light emitting elements. The photosensitive member forms a latent image by being exposed by light emitted from the light emitting element array. The transparent member is positioned between the photosensitive member and the light emitting element array. The transparent member has a relative position fixed with respect to the light emitting element array, and transmits the light emitted from the light emitting element array. The gap spacer keeps a distance between the photosensitive member and the transparent member constant. The biasing member biases the transparent member toward the photosensitive member.

Hereinafter, embodiments will be described with reference to the accompanying drawings.

Figure 1:
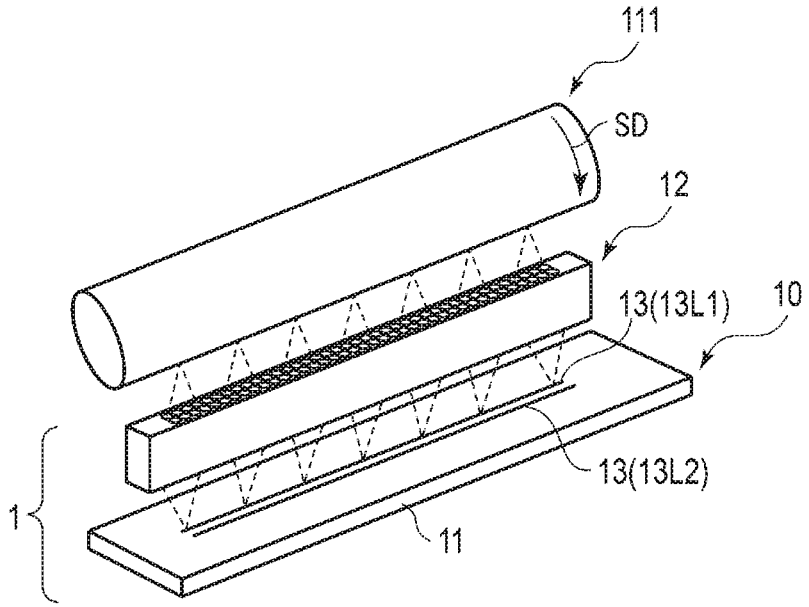
FIG. 1 is a perspective view illustrating a basic configuration of a photosensitive drum and a print head applied to an image forming apparatus according to an embodiment.

FIG. 1 is a perspective view illustrating a basic configuration of a photosensitive drum and a print head applied to an image forming apparatus according to an embodiment. For example, an image forming apparatus such as a printer, a copying machine, and a multi-functional peripheral is provided with a photosensitive drum 111 illustrated in FIG. 1, and a print head 1 is disposed to be opposite to the photosensitive drum 111.

The photosensitive drum 111 rotates in the direction of an arrow illustrated in FIG. 1. This rotation direction is referred to as a sub-scanning direction SD. The photosensitive drum 111 is uniformly charged by an electrostatic charger and is exposed by light outputted from the print head 1, thereby lowering a potential of an exposure unit thereof. That is, an electrostatic latent image can be formed on the photosensitive drum 111 by controlling light emission and non-light emission of the print head 1.

The print head 1 includes a light emitting unit 10. The light emitting unit 10 includes a transparent substrate 11. For example, the transparent substrate 11 is a glass substrate which transmits light. The transparent substrate 11 is formed with high surface accuracy. A single or a plurality of light emitting element arrays 13 are provided on the transparent substrate 11. Each light emitting element array 13 includes a plurality of light emitting elements. Each light emitting element array 13 is disposed in parallel to a rotation axis of the photosensitive drum 111. The light emitting element is, for example, an LED. The light emitting unit 10 including the LED is formed, for example, by arranging LED chips on the transparent substrate 11 and bonding the LED chips thereon. Alternatively, the light emitting element is, for example, an organic EL (OLED). The light emitting unit 10 including the organic EL is configured by collectively forming the organic EL on the transparent substrate 11 by, for example, a lithography technology using a mask. Therefore, the light emitting unit 10 including the organic EL can arrange the light emitting elements side by side with higher positional accuracy in comparison with the light emitting unit 10 including the LED.

The print head 1 also includes a rod lens array 12. The rod lens array 12 is disposed between the light emitting unit 10 and the photosensitive drum 111. More specifically, the rod lens array 12 is disposed between the light emitting element array 13 and the photosensitive drum 111. The rod lens array 12 is disposed in parallel to the rotation axis of the photosensitive drum 111. The rod lens array 12 condenses the light emitted from the light emitting element array 13 of the light emitting unit 10 on the photosensitive drum 111.

FIG. 1 illustrates an example in which two arrays of a first light emitting element array 13L1 and a second light emitting element array 13L2 are formed in parallel with each other. In the embodiment, an example in which the print head 1 includes two light emitting element arrays 13 will be described, but an example in which the print head 1 includes one light emitting element array 13 is also assumed.

Figure 2:
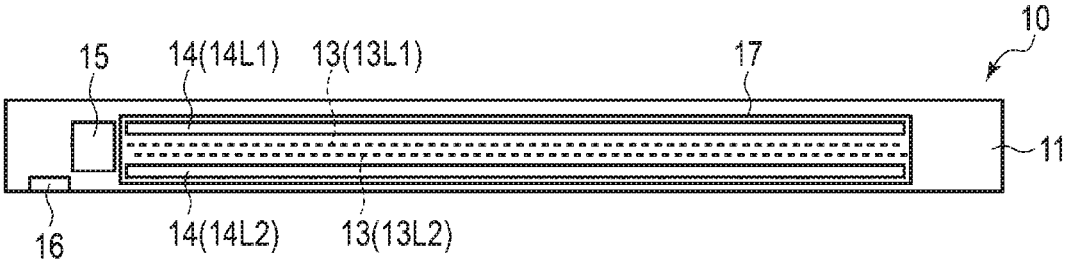
FIG. 2 is a view illustrating an example of the print head.

FIG. 2 is a view illustrating an example of a transparent substrate forming the print head illustrated in FIG. 1. As illustrated in FIG. 2, the two light emitting element arrays 13 (the first light emitting element array 13L1 and the second light emitting element array 13L2) are provided at a central portion on the transparent substrate 11 along the longitudinal direction of the transparent substrate 11. A drive circuit array 14 (a first drive circuit array 14L1 and a second drive circuit array 14L2) for driving (e.g., causing each light emitting element to emit light) each light emitting element is formed near the light emitting element array 13.

As illustrated in FIG. 2, for example, the drive circuit arrays 14 are disposed on opposite sides of the two light emitting element arrays 13. The drive circuit array 14 may be disposed on one side of the two light emitting element arrays 13. The light emitting element array 13 and the drive circuit array 14 are covered with a transparent cover 17 so as not to touch the outside air.

An integrated circuit (IC) 15 is disposed at an end part of the transparent substrate 11. The transparent substrate 11 includes a connector 16. The connector 16 is electrically connected to the print head 1 and a control system of the image forming apparatus. Power supply, head control, and transfer of image data can be performed by this connection. When it is difficult to mount the connector 16 on the transparent substrate 11, flexible printed circuits (FPC) may be connected to the transparent substrate 11 and an electrical connection with the control system may be implemented via the FPC.

Figure 3:
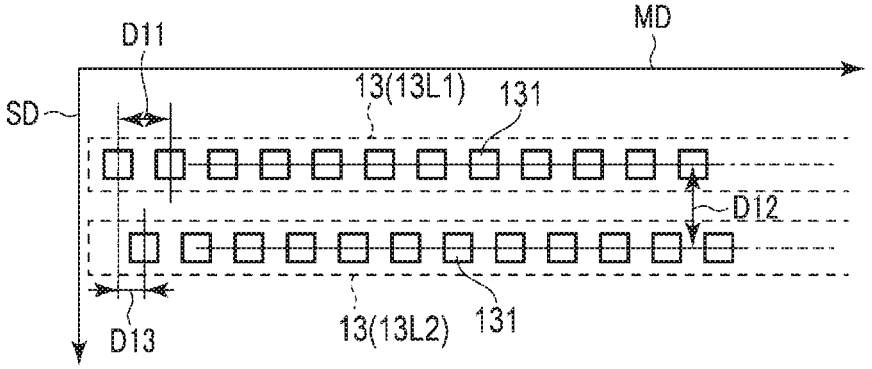
FIG. 3 is a view illustrating an example of the print head (a two-row head), and is a view illustrating a light emitting element array on a transparent substrate.

FIG. 3 is a view illustrating an example of the light emitting element array (a two-row head) illustrated in FIG. 2. As illustrated in FIG. 3, each light emitting element array 13 (the first light emitting element array 13L1 and the second light emitting element array 13L2) includes a plurality of light emitting elements 131 disposed along the main scanning direction MD orthogonal to the moving direction (the sub-scanning direction SD) of the photosensitive drum 111. That is, an arrangement direction of the plurality of light emitting elements 131 forming the first light emitting element array 13L1 and an arrangement direction of the plurality of light emitting elements 131 forming the second light emitting element array 13L2 are parallel to the main scanning direction MD.

The light emitting element 131 has a square size of, for example, 20 μm. Both of the light emitting elements 131 of the first light emitting element array 13L1 and the light emitting elements 131 of the second light emitting element array 13L2 are disposed at a predetermined arrangement space D11 along the main scanning direction MD. The arrangement space D11 of the light emitting element 131 is, for example, about 42.3 μm in which the resolution becomes 600 dpi.

The first light emitting element array 13L1 and the second light emitting element array 13L2 are disposed at a space of a distance D12 with respect to the sub-scanning direction SD. Each light emitting element 131 forming the first light emitting element array 13L1 and each light emitting element 131 forming the second light emitting element array 13L2 are disposed to be deviated only by a predetermined pitch D13 with respect to the main scanning direction MD. For example, the predetermined pitch D13 is ½ of the arrangement space D11. Accordingly, the two light emitting element arrays 13 are disposed in a zigzag shape.

When the light emitting element of the first light emitting element array 13L1 and the light emitting element of the second light emitting element array 13L2 emit light at the same timing, an exposure pattern of the zigzag shape is formed on the photosensitive drum 111. In this case, for convenience, the light emitting element array 13 on the upstream side with respect to the moving direction of the photosensitive drum 111 is referred to as the first light emitting element array 13L1 and the light emitting element array 13 on the downstream side with respect to the moving direction of the photosensitive drum 111 is referred to as the second light emitting element array 13L2. A control unit that controls the operation of image formation causes the first light emitting element array 13L1 and the second light emitting element array 13L2 to emit light at a different timing according to a moving speed of the photosensitive drum 111 and the distance D12. That is, the control unit delays the light emitting timing of the second light emitting element array 13L2 with respect to the first light emitting element array 13L1 for a predetermined time according to the moving speed of the photosensitive drum 111 and the distance D12. In other words, the control unit outputs first light emitting element image data to the first light emitting element array 13L1 and second light emitting element image data to the second light emitting element array 13L2 at a different timing according to the moving speed of the photosensitive drum 111 and the distance D12. Here, the first light emitting element image data and the second light emitting element image data correspond to image data for one line in the main scanning direction. Accordingly, a latent image is formed on the photosensitive drum at a resolution of 1,200 dpi.

As described above, high density of the image can be achieved in such a manner that the control unit controls the light emitting timing (image data transfer timing) of the plurality of light emitting element arrays 13. In the case of two light emitting element arrays 13, the high density of the image can be doubled with respect to the density of the light emitting element 131 per one array, and thus, in the case of n (n≥3, n: integer) pieces of light emitting element arrays 13, the density of the image n times higher than the density of the light emitting element 131 per one array can be achieved.

Figure 4:
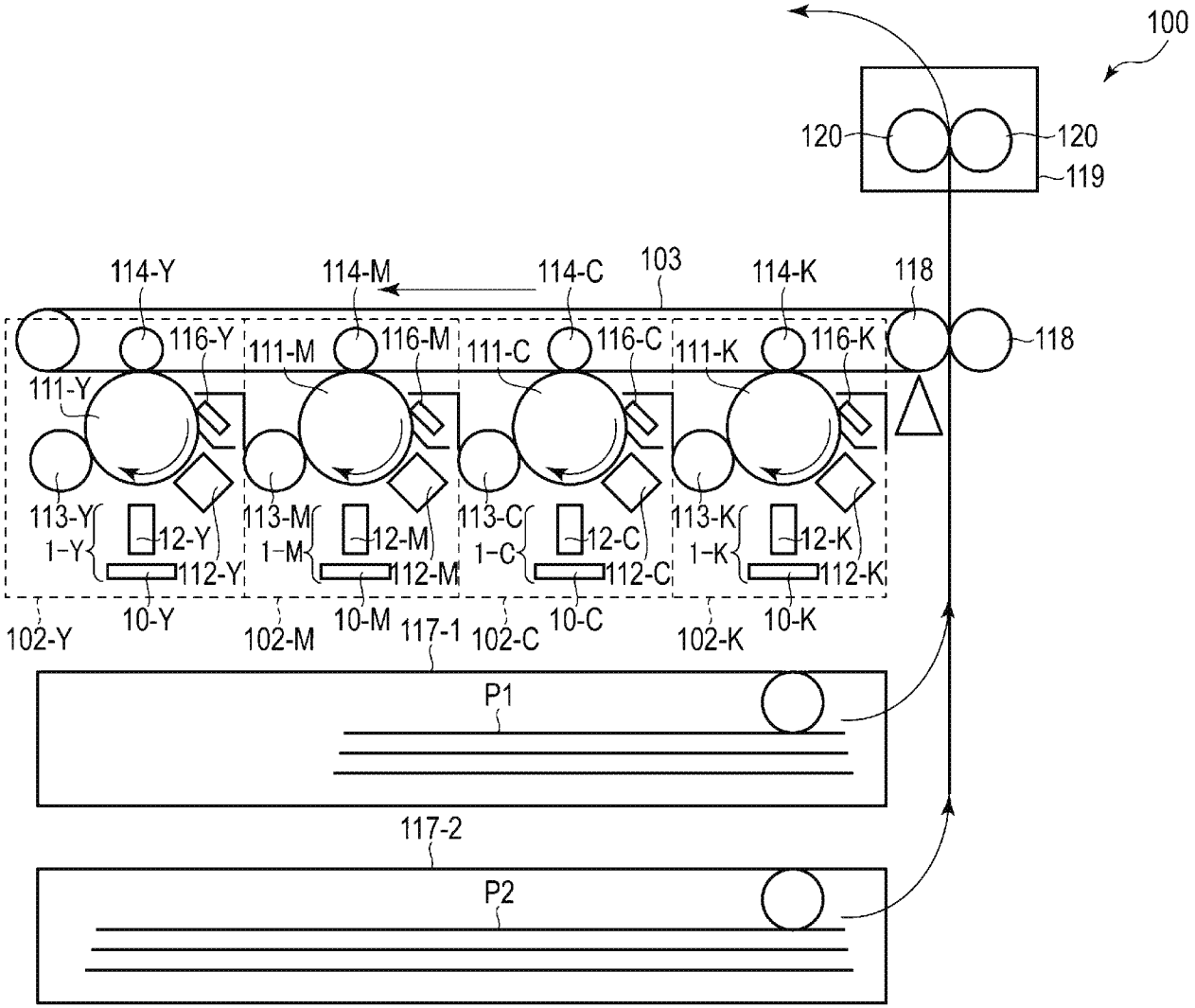
FIG. 4 is a view illustrating an example of the image forming apparatus to which the print head is applied.

FIG. 4 is a view illustrating an example of the image forming apparatus to which the print head illustrated in FIG. 1 is applied. FIG. 4 illustrates an example of a four-tandem color image forming apparatus, but the print head 1 illustrated in FIG. 1 can be also applied to a monochrome image forming apparatus.

As illustrated in FIG. 4, for example, the image forming apparatus 100 includes: an image forming unit 102-Y for forming an image of yellow (Y); an image forming unit 102-M for forming an image of magenta (M); an image forming unit 102-C for forming an image of cyan (C); and an image forming unit 102-*k* for forming an image of black (K). The image forming units 102-Y, 102-M, 102-C, and 102-K respectively form yellow, cyan, magenta, and black images, and transfer the respective images to a transfer belt 103. Thus, a full color image is formed on the transfer belt 103.

The image forming unit 102-Y includes an electrostatic charger 112-Y, a print head 1-Y, a developing device 113-Y, a transfer roller 114-Y, and a cleaner 116-Y around a photosensitive drum 111-Y. The same configuration is respectively applied to the image forming units 102-M, 102-C, and 102-K.

In FIG. 4, the configuration of the image forming unit 102-Y for forming the image of yellow (Y) is denoted by a reference sign of "-Y". The configuration of the image forming unit 102-M for forming the image of magenta (M) is denoted by a reference sign of "-M". The configuration of the image forming unit 102-C for forming the image of cyan (C) is denoted by a reference sign of "-C". The configuration of the image forming unit 102-K for forming the image of black (K) is denoted by a reference sign of "-K".

The electrostatic chargers 112-Y, 112-M, 112-C, and 112-K uniformly charge the photosensitive drums 111-Y, 111-M, 111-C, and 111-K, respectively. The print heads 1-Y, 1-M, 1-C, and 1-K respectively expose the photosensitive drums 111-Y, 111-M, 111-C, and 111-K by the light emission of the light emitting elements 131 of the first light emitting element array 13L1 and the second light emitting element array 13L2, respectively, after which an electrostatic latent image is formed on the photosensitive drums 111-Y, 111-M, 111-C, and 111-K. The developing device 113-Y adheres (e.g., develops) yellow toner to an electrostatic latent image portion of the photosensitive drum 111-Y; the developing device 113-M adheres (e.g., develops) magenta toner to an electrostatic latent image portion of the photosensitive drum 111-M; the developing device 113-C adheres (e.g., develops) cyan toner to an electrostatic latent image portion of the photosensitive drum 111-C; and the developing device 113-K adheres (e.g., develops) black toner to an electrostatic latent image portion of the photosensitive drum 111-K.

The transfer rollers 114-Y, 114-M, 114-C, and 114-K respectively transfer the toner images developed on photosensitive drums 111-Y, 111-M, 111-C, and 111-K to the transfer belt 103. The cleaners 116-Y, 116-M, 116-C, and 116-K clean toner remaining respectively on the photosensitive drums 111-Y, 111-M, 111-C, and 111-K without being transferred thereto. Thus, the photosensitive drums 111-Y, 111-M, 111-C, 111-K become in a standby state for the next image formation.

Paper P1 of a first size (e.g., a small size) is stored in a paper cassette 117-1. Paper P2 of a second size (e.g., a large size) is stored in a paper cassette 117-2.

The toner image is transferred from the transfer belt 103 onto the paper P1 or P2 picked out of the paper cassette 117-1 or 117-2 by a pair of transfer rollers 118. The paper P1 or P2 onto which the toner image is transferred is heated and pressurized by a fixing roller 120 of a fixing unit 119. The toner image is firmly fixed onto the paper P1 or P2 by heating and pressurization performed by the fixing roller 120. An image forming operation is continuously performed by repeating the above-described process operation.

First Embodiment

Figure 5:
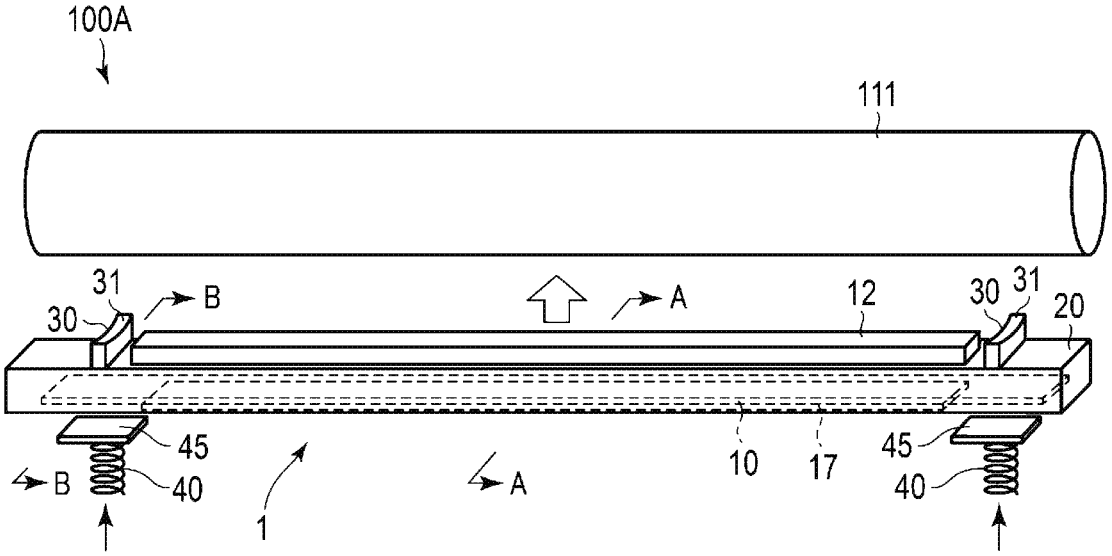
FIG. 5 is a view illustrating a photosensitive drum and a print head in an image forming apparatus according to a first embodiment.
Figure 6:
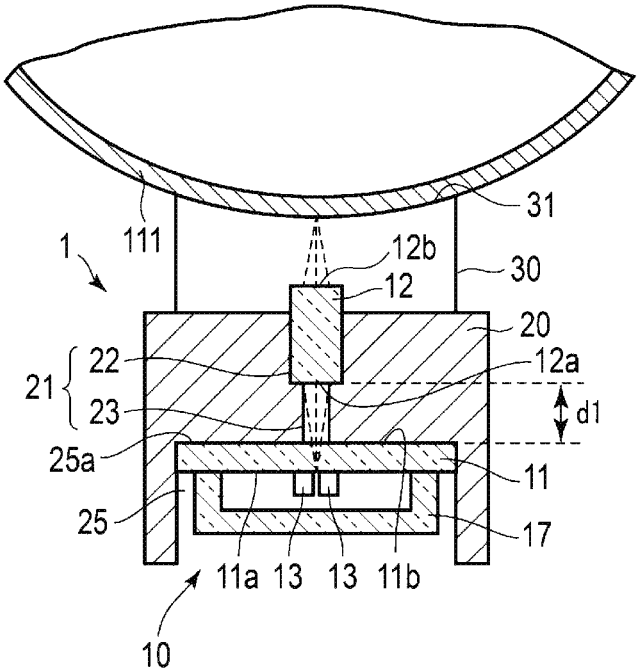
FIG. 6 is a cross sectional view of the photosensitive drum and the print head taken along the line A-A of FIG. 5.
Figure 7:
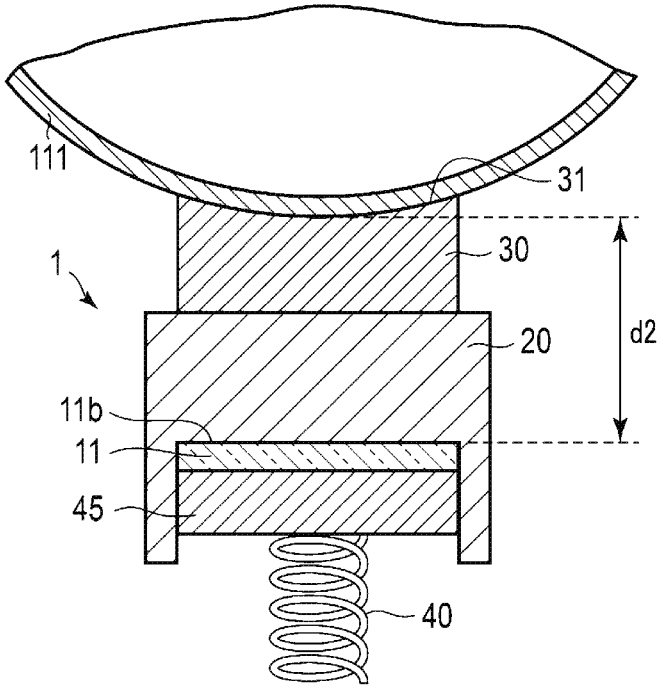
FIG. 7 is a cross sectional view taken along the line B-B of FIG. 5.

Hereinafter, an image forming apparatus 100A according to a first embodiment which is an example of the embodiment will be described with reference to FIGS. 5 to 7. Here, for convenience, a part of the image forming apparatus 100A, mainly the photosensitive drum 111 and the print head 1 will be described with reference to FIGS. 5 to 7. FIG. 5 is a view illustrating the photosensitive drum 111 and the print head 1 in the image forming apparatus 100A of the first embodiment. FIG. 6 is a cross sectional view of the photosensitive drum 111 and the print head 1 taken along the line A-A of FIG. 5. FIG. 7 is a cross sectional view of the photosensitive drum 111 and the print head 1 taken along the line B-B of FIG. 5.

The light emitting unit 10 includes, for example, the transparent cover 17 mounted on the transparent substrate 11. The transparent cover 17 is an elongated box-shaped member with one surface thereof open, and extends along the longitudinal direction of the transparent substrate 11. For example, the transparent cover 17 cooperates with the transparent substrate 11 to seal, for example, the light emitting element array 13, the drive circuit array 14, and the wiring so that the light emitting element array 13, the drive circuit array 14, and the wiring do not touch the outside air. Relative positions of both the transparent substrate 11 and the transparent cover 17 with respect to the light emitting element array 13 are fixed. That is, the relative positions of the transparent substrate 11 and the transparent cover 17 with respect to the light emitting element array 13 are unchanged. For example, the transparent cover 17 is a glass cover that transmits light.

Here, for convenience, in the following description, a surface of the transparent substrate 11 on which the light emitting element array 13 is formed is referred to as an inner surface 11*a*, and a surface of the transparent substrate 11 positioned on the opposite side to the inner surface 11*a* of the transparent substrate 11 on which the light emitting element array 13 is formed is referred to as an outer surface 11*b*.

The print head 1 also includes a holder 20 that holds the rod lens array 12 and the transparent substrate 11. The holder 20 has a slit 21 extending in the longitudinal direction. The slit 21 penetrates the holder 20. The slit 21 includes a wide width unit 22 and a narrow width unit 23 that are continuous with each other. The wide width unit 22 is positioned on the outer side, that is, the side closer to the photosensitive drum 111, and the narrow width unit 23 is positioned on the inner side, that is, the side farther from the photosensitive drum 111. A dimension of the wide width unit 22 in the short direction of the holder 20 is larger than that of the narrow width unit 23. The rod lens array 12 is accommodated and fixed in the wide width unit 22 of the slit 21.

Here, for convenience, a surface of the rod lens array 12 facing the transparent substrate 11 is referred to as an inner surface 12*a*, and a surface of the rod lens array 12 facing the photosensitive drum 111 is referred to as an outer surface 12*b*.

The holder 20 also includes a recess 25 extending in the longitudinal direction. The light emitting unit 10 is accommodated and fixed in the recess 25. The recess 25 includes a flat bottom surface 25*a*. The bottom surface 25*a* is formed with high surface accuracy. The light emitting unit 10 is fixed so that the outer surface 11*b* of the transparent substrate 11 contacts the bottom surface 25*a* of the recess 25 of the holder 20. The outer surface 11*b* of the transparent substrate 11 is formed with high surface accuracy, and the bottom surface 25*a* of the recess 25 is also formed with high surface accuracy. Accordingly, the rod lens array 12 has a relative position fixed with respect to the light emitting element array 13. That is, a distance d1 between the outer surface 11*b* of the transparent substrate 11 and the inner surface 12*a* of the rod lens array 12 is kept constant with high accuracy.

As described above, in the print head 1 in which the light emitting unit 10 is fixed to the holder 20, the transparent substrate 11 is positioned between the light emitting element array 13 and the photosensitive drum 111, more specifically, positioned between the light emitting element array 13 and the rod lens array 12, and transmits light emitted from the light emitting element array 13 and directed toward the rod lens array 12.

The image forming apparatus 100A includes one or more gap spacers 30. For example, the image forming apparatus 100A includes two gap spacers 30. The gap spacer 30 keeps a distance between the photosensitive drum 111 and the transparent substrate 11 constant. The two gap spacers 30 are positioned between the photosensitive drum 111 and the holder 20, and are disposed on opposite sides of the rod lens array 12 along the longitudinal direction of the holder 20. For example, the gap spacer 30 is fixed to the holder 20.

The two gap spacers 30 are formed of the same structure. That is, the two gap spacers 30 have the same shape. The gap spacer 30 is processed with high accuracy. The gap spacer 30 includes a concave curved surface facing the photosensitive drum 111, for example, a rotating cylindrical surface 31. The rotating cylindrical surface 31 of the gap spacer 30 has a radius of curvature equal to or smaller than a radius of curvature of the photosensitive drum 111. Desirably, the rotating cylindrical surface 31 of the gap spacer 30 has the radius of curvature equal to the radius of curvature of the photosensitive drum 111.

The image forming apparatus 100A also includes one or more biasing members 40. For example, the image forming apparatus 100A includes the same number of the gap spacer 30, that is, two biasing members 40. The number of biasing members 40 is not limited to the same as the number of gap spacers 30. The plurality of biasing members 40 may be provided to one gap spacer 30. The biasing member 40 biases the transparent substrate 11 toward the photosensitive drum 111. The biasing member 40 is formed of, for example, a coil spring. However, the biasing member 40 is not limited thereto, and may be formed of other members, such as, for example, an elastic body such as a leaf spring, rubber, and sponge.

The image forming apparatus 100A further includes one or more protection members 45. For example, the image forming apparatus 100A includes the same number of the gap spacers 30, that is, two protection members 45. The protection member 45 is disposed between the transparent substrate 11 and the biasing member 40. The protection member 45 protects the transparent substrate 11 from force applied by the biasing member 40. For example, the protection member 45 absorbs the force received from the biasing member 40 and serves to weaken the force transmitted to the transparent substrate 11. Alternatively, the protection member 45 causes the force received from the biasing member 40 to disperse and serves to reduce stress concentration on the transparent substrate 11. The protection member 45 is formed of, for example, a material such as resin or rubber.

The biasing member 40 and the protection member 45 are aligned with the gap spacer 30. That is, the biasing member 40, the protection member 45, and the gap spacer 30 are positioned on a straight line perpendicular to the rotation axis of the photosensitive drum 111. For example, the biasing member 40, the protection member 45, and the gap spacer 30 are disposed on opposite sides of the transparent cover 17 along the longitudinal direction of the transparent substrate 11.

The biasing member 40 biases the transparent substrate 11 toward the photosensitive drum 111 via the protection member 45. In other words, the protection member 45 contacts the transparent substrate 11 at positions on opposite sides of the transparent cover 17 along the longitudinal direction of the transparent substrate 11, and the biasing member 40 biases the protection member 45 toward the photosensitive drum 111. As a result, the whole print head 1 is biased toward the photosensitive drum 111. Thus, the print head 1 receives force for causing the print head 1 to approach the photosensitive drum 111. However, the gap spacer 30 is disposed between the photosensitive drum 111 and the print head 1, and the gap spacer 30 limits the approach of the print head 1. The gap spacer 30 keeps a distance d2 between the outer surface 11*b* of the transparent substrate 11 and the photosensitive drum 111 constant by contacting the photosensitive drum 111 and the holder 20.

Since the biasing member 40, the protection member 45, and the gap spacer 30 are aligned, the biasing force applied by the biasing member 40 is transmitted uniformly to the protection member 45, the transparent substrate 11, and the gap spacer 30. The gap spacer 30 is processed with high accuracy. Since the rotating cylindrical surface 31 of the gap spacer 30 has the radius of curvature equal to the radius of curvature of the photosensitive drum 111, the gap spacer 30 closely contacts the photosensitive drum 111 without rattling. Accordingly, the distance d2 between the outer surface 11*b* of the transparent substrate 11 and the photosensitive drum 111 is kept constant with high accuracy. A foreign substance such as toner is prevented from entering a gap portion therebetween.

In the image forming apparatus 100A according to the embodiment, the rod lens array 12 is disposed with high positional accuracy with respect to the light emitting element array 13 by the holder 20 on the basis of the outer surface 11*b* of the transparent substrate 11 as a reference. By a simple configuration including the gap spacer 30, the biasing member 40, and the protection member 45, the light emitting element array 13 is disposed with high positional accuracy with respect to the photosensitive drum 111 on the basis of the outer surface 11*b* of the transparent substrate 11 as a reference.

First Modification

Figure 8:
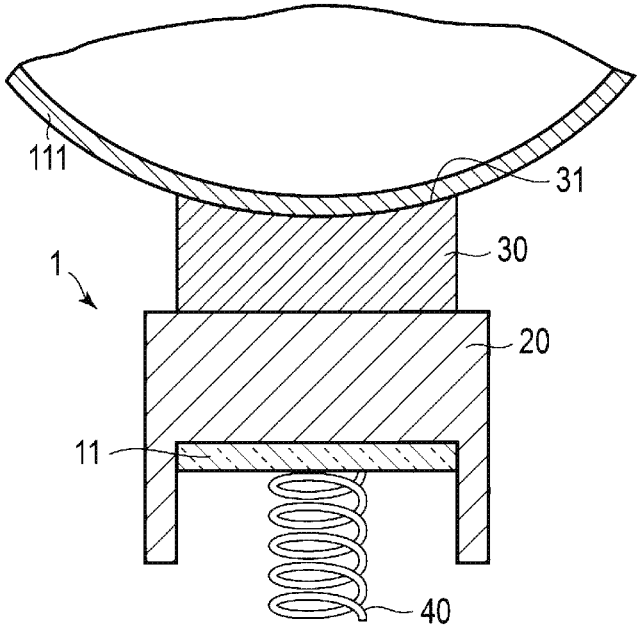
FIG. 8 is a cross sectional view of a photosensitive drum and a print head according to a first modification.

A first modification of the image forming apparatus 100A according to the embodiment will be described with reference to FIG. 8. FIG. 8 is a cross sectional view of the photosensitive drum 111 and the print head 1 according to the first modification. FIG. 8 illustrates a cross section corresponding to a cross section taken along the line B-B of FIG. 5. In FIG. 8, members denoted by the same reference signs as those illustrated in FIGS. 5 to 7 are the same members, and the detailed description thereof will be omitted. Hereinafter, only the differences therebetween will be mainly described.

The modification has a configuration in which the protection member 45 is omitted from the image forming apparatus 100A illustrated in FIGS. 5 to 7. When the transparent substrate 11 has sufficient strength against the force applied by the biasing member 40, the protection member 45 is not necessarily required, and the biasing member 40 may be configured to directly contact the transparent substrate 11 as illustrated in the modification.

According to the modification, the number of parts is reduced and thus assembly becomes easier.

Second Modification

Figure 9:
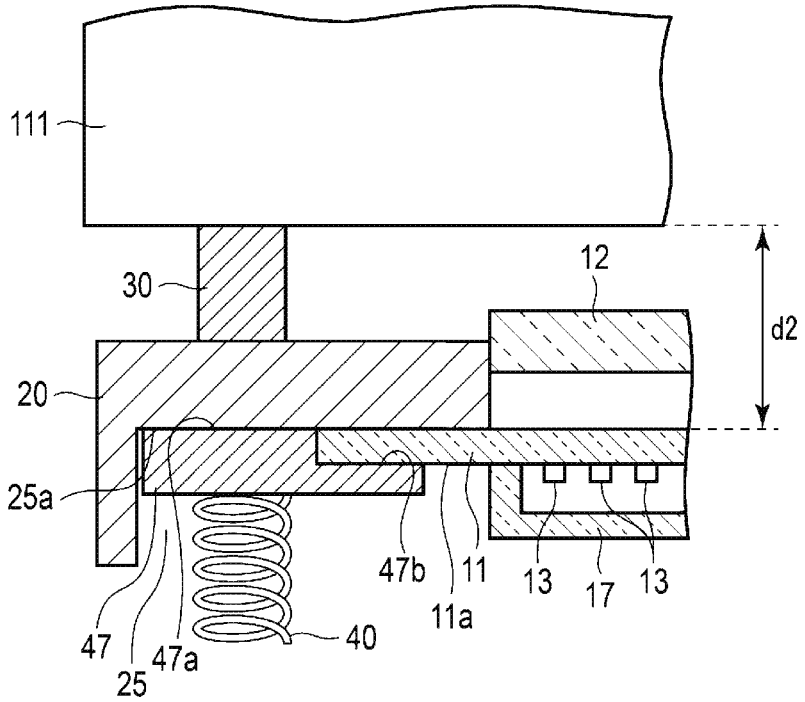
FIG. 9 is a cross sectional view of a photosensitive drum and a print head according to a second modification.

A second modification of the image forming apparatus 100A according to the embodiment will be described with reference to FIG. 9. FIG. 9 is a partial side view of the photosensitive drum 111 and the print head 1 according to the second modification. In FIG. 9, members denoted by the same reference signs as those illustrated in FIGS. 5 to 7 are the same members, and the detailed description thereof will be omitted. Hereinafter, only the differences therebetween will be mainly described.

The modification includes another protection member 47 instead of the protection member 45. The protection member 47 has a level difference. The level difference of the protection member 47 is equal to the thickness of the transparent substrate 11. Therefore, the protection member 47 includes a surface 47*a* in contact with the bottom surface 25*a* of the recess 25 of the holder 20 and a surface 47*b* in contact with the inner surface 11*a* of the transparent substrate 11.

The biasing member 40 is aligned with the gap spacer 30. That is, the biasing member 40 and the gap spacer 30 are positioned on a straight line perpendicular to the rotation axis of the photosensitive drum 111. For example, the biasing member 40, the protection member 47, and the gap spacer 30 are disposed on opposite sides of the transparent cover 17 along the longitudinal direction of the transparent substrate 11.

The biasing member 40 biases the protection member 47 toward the photosensitive drum 111. The protection member 47 causes a portion thereof having the surface 47*a* to bias the holder 20 toward the photosensitive drum 111, and causes a portion thereof having the surface 47*b* to bias the transparent substrate 11 toward the photosensitive drum 111. As a result, the whole print head 1 is biased toward the photosensitive drum 111. The gap spacer 30 is disposed between the photosensitive drum 111 and the print head 1, and the gap spacer 30 keeps a distance d2 between an outer surface 17*a* of the transparent cover 17 and the photosensitive drum 111 constant by contacting the photosensitive drum 111 and the holder 20. When the gap spacer 30 is fixed to the holder 20, the gap spacer 30 keeps the distance d2 between the outer surface 17*a* of the transparent cover 17 and the photosensitive drum 111 constant by contacting the photosensitive drum 111.

In the modification, the rod lens array 12 is disposed with high positional accuracy with respect to the light emitting element array 13 by the holder 20 on the basis of the outer surface 17*a* of the transparent cover 17 as a reference. By a simple configuration including the gap spacer 30, the biasing member 40, and the protection member 47, the light emitting element array 13 is disposed with high positional accuracy with respect to the photosensitive drum 111 on the basis of the outer surface 17*a* of the transparent cover 17 as a reference.

Third Modification

Figure 10:
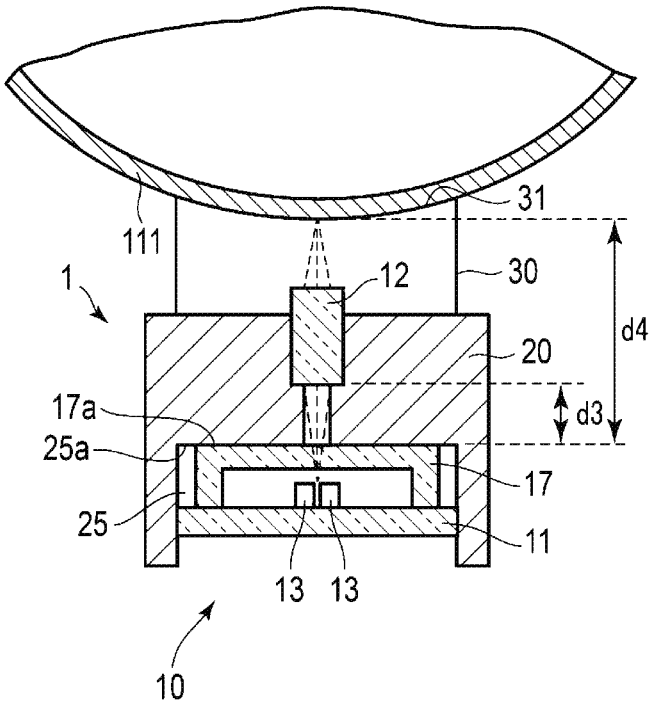
FIG. 10 is a cross sectional view of a photosensitive drum and a print head according to a third modification.

A third modification of the image forming apparatus 100A according to the embodiment will be described with reference to FIG. 10. FIG. 10 is a cross sectional view of the photosensitive drum 111 and the print head 1 according to the third modification. FIG. 10 illustrates a cross section corresponding to a cross section taken along the line A-A of FIG. 5. In FIG. 10, members denoted by the same reference signs as those illustrated in FIGS. 5 to 7 are the same members, and the detailed description thereof will be omitted. Hereinafter, only the differences therebetween will be mainly described.

In the modification, the light emitting unit 10 is fixed so that the outer surface 17*a* of the transparent cover 17 contacts the bottom surface 25*a* of the recess 25 of the holder 20. Thus, the rod lens array 12 has a relative position fixed with respect to the light emitting element array 13. That is, a distance d3 between the outer surface 17*a* of the transparent cover 17 and the inner surface 12*a* of the rod lens array 12 is kept constant.

In the print head 1 in which the light emitting unit 10 is fixed to the holder 20, the transparent cover 17 is positioned between the light emitting element array 13 and the photosensitive drum 111, and more specifically, positioned between the light emitting element array 13 and the rod lens array 12, and transmits light emitted from the light emitting element array 13 and directed toward the rod lens array 12.

Although not illustrated herein, in the modification, the biasing member 40 biases the transparent substrate 11 toward the photosensitive drum 111 via the protection member 45. As a result, the whole print head 1 is biased toward the photosensitive drum 111. The gap spacer 30 is disposed between the photosensitive drum 111 and the print head 1, and the gap spacer 30 keeps a distance d4 between the outer surface 17*a* of the transparent cover 17 and the photosensitive drum 111 constant by contacting the photosensitive drum 111 and the holder 20. When the gap spacer 30 is fixed to the holder 20, the gap spacer 30 keeps the distance d4 between the outer surface 17*a* of the transparent cover 17 and the photosensitive drum 111 constant by contacting the photosensitive drum 111.

In the modification, the rod lens array 12 is disposed with high positional accuracy with respect to the light emitting element array 13 by the holder 20 on the basis of the outer surface 17*a* of the transparent cover 17 as a reference. By a simple configuration including the gap spacer 30, the biasing member 40, and the protection member 45, the light emitting element array 13 is disposed with high positional accuracy with respect to the photosensitive drum 111 on the basis of the outer surface 17*a* of the transparent cover 17 as a reference.

Fourth Modification

Figure 11:
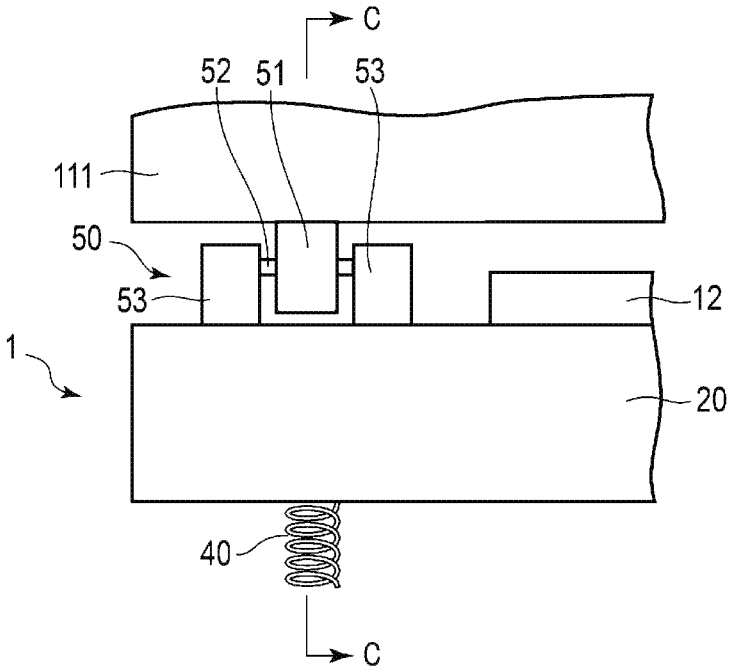
FIG. 11 is a partial side view of a photosensitive drum and a print head according to a fourth modification.
Figure 12:
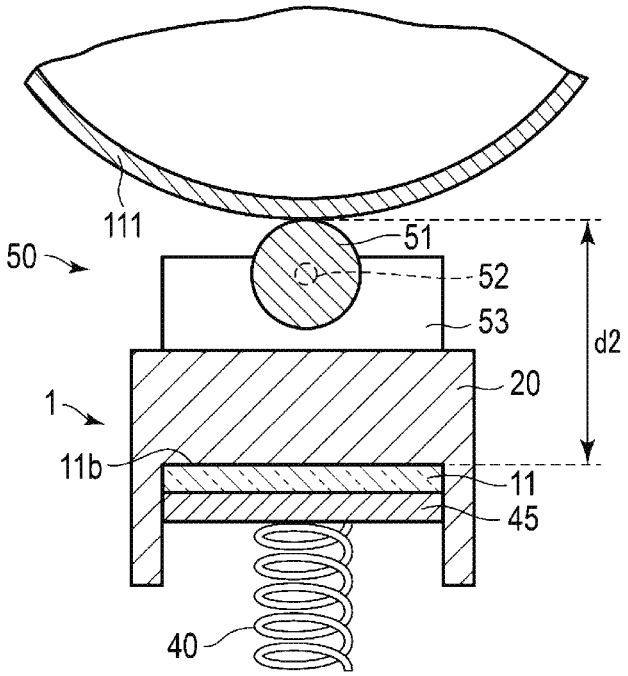
FIG. 12 is a cross sectional view of the photosensitive drum and the print head taken along the line C-C of FIG. 11.

A fourth modification of the image forming apparatus 100A according to the embodiment will be described with reference to FIGS. 11 and 12. FIG. 11 is a partial side view of the photosensitive drum 111 and the print head 1 according to the fourth modification. FIG. 12 is a cross sectional view of the photosensitive drum 111 and the print head 1 taken along the line C-C of FIG. 11. In FIGS. 11 and 12, members denoted by the same reference signs as those illustrated in FIGS. 5 to 7 are the same members, and the detailed description thereof will be omitted. Hereinafter, only the differences therebetween will be mainly described.

In the modification, the gap spacer 30 illustrated in FIGS. 5 to 7 is replaced with another gap spacer 50. The gap spacer 50 has a cylindrical roller 51 and a pair of support bodies 53 for rotatably supporting the roller 51. The roller 51 has a rotation shaft 52, and the center axis of the rotation shaft 52 is parallel to the rotation axis of the photosensitive drum 111. For example, the pair of support bodies 53 is disposed on opposite sides of the roller 51 along the longitudinal direction of the holder 20, and is fixed to the holder 20. Each of the support bodies 53 includes a bearing that receives the rotation shaft 52 of the roller 51. Thus, the pair of support bodies 53 rotatably supports the roller 51.

In the modification, the biasing member 40 biases the transparent substrate 11 toward the photosensitive drum 111 via the protection member 45. As a result, the whole print head 1 is biased toward the photosensitive drum 111. The gap spacer 50 is disposed between the photosensitive drum 111 and the print head 1. The gap spacer 50 keeps a distance d2 between the outer surface 11*b* of the transparent substrate 11 and the photosensitive drum 111 constant by causing the roller 51 to contact the photosensitive drum 111.

In the modification, by a simple configuration including the gap spacer 50, the biasing member 40, and the protection member 45, the light emitting element array 13 is disposed with high positional accuracy with respect to the photosensitive drum 111 on the basis of the outer surface 11*b* of the transparent substrate 11 as a reference. Since the roller 51 contacts the photosensitive drum 111 with a line and is rotatably supported by the pair of support bodies 53, frictional force generated between the photosensitive drum 111 and the roller 51 is reduced. The above-described fact reduces a load on a support mechanism of the photosensitive drum 111.

Fifth Modification

Figure 13:
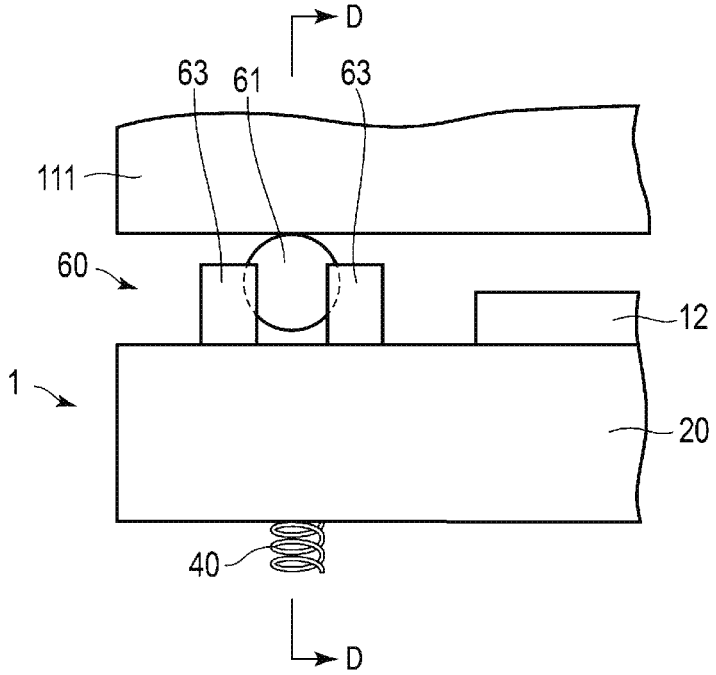
FIG. 13 is a partial side view of a photosensitive drum and a print head according to a fifth modification.
Figure 14:
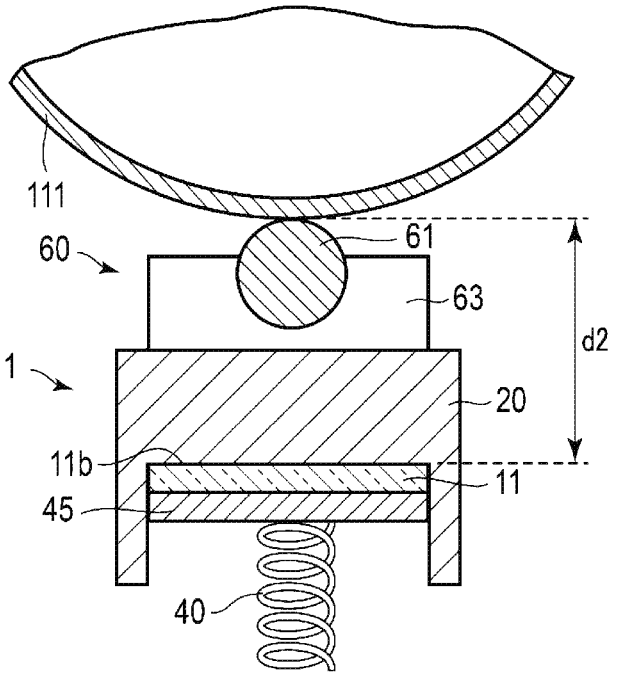
FIG. 14 is a cross sectional view of the photosensitive drum and the print head taken along the line D-D of FIG. 13.

A fifth modification of the image forming apparatus 100A according to the embodiment will be described with reference to FIGS. 13 and 14. FIG. 13 is a partial side view of the photosensitive drum 111 and the print head 1 according to the fifth modification. FIG. 14 is a cross sectional view of the photosensitive drum 111 and the print head 1 taken along the line D-D of FIG. 13. In FIGS. 13 and 14, members denoted by the same reference signs as those illustrated in FIGS. 5 to 7 are the same members, and the detailed description thereof will be omitted. Hereinafter, only the differences therebetween will be mainly described.

In the modification, the gap spacer 30 illustrated in FIGS. 5 to 7 is replaced with another gap spacer 60. The gap spacer 60 includes a roller or spherical body 61 and a pair of support bodies 63 for rotatably supporting the spherical body 61. For example, the pair of support bodies 63 is disposed on opposite sides of the spherical body 61 along the longitudinal direction of the holder 20 and is fixed to the holder 20. Each of the support bodies 63 has a recess for receiving the spherical body 61. Thus, the pair of support bodies 63 rotatably supports the spherical body 61 in any direction.

In the modification, the biasing member 40 biases the transparent substrate 11 toward the photosensitive drum 111 via the protection member 45. As a result, the whole print head 1 is biased toward the photosensitive drum 111. The gap spacer 60 is disposed between the photosensitive drum 111 and the print head 1. The gap spacer 60 keeps a distance d2 between the outer surface 11*b* of the transparent substrate 11 and the photosensitive drum 111 constant by causing the spherical body 61 to contact the photosensitive drum 111 at a point.

In the modification, by a simple configuration including the gap spacer 60, the biasing member 40, and the protection member 45, the light emitting element array 13 is disposed with high positional accuracy with respect to the photosensitive drum 111 on the basis of the outer surface 11*b* of the transparent substrate 11 as a reference. Since the spherical body 61 contacts the photosensitive drum 111 at a point and is rotatably supported by the pair of support bodies 63 in any direction, frictional force generated between the photosensitive drum 111 and the spherical body 61 is reduced. The above-described fact reduces a load on a support mechanism of the photosensitive drum 111.

Second Embodiment

Figure 15:
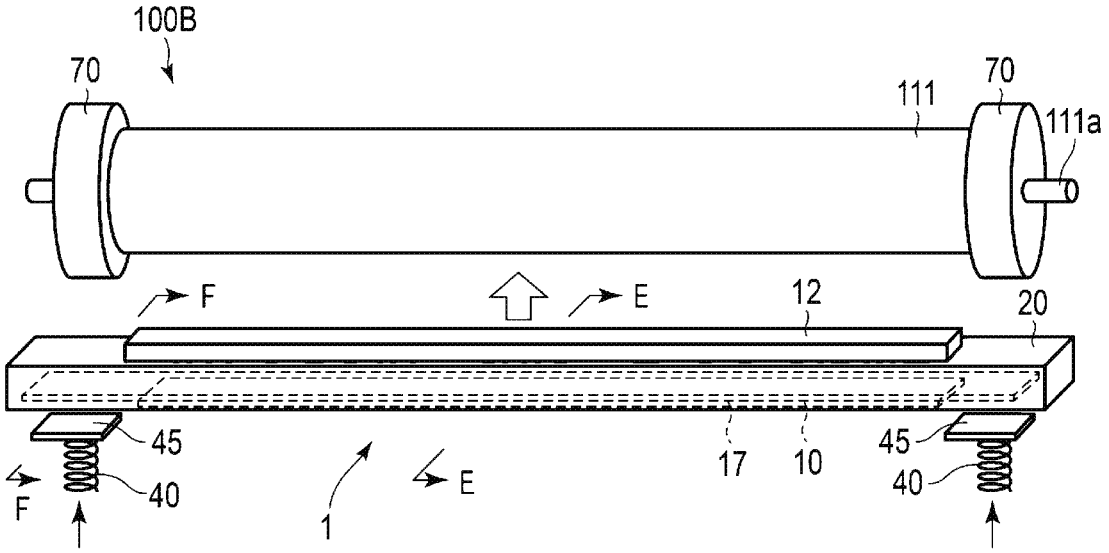
FIG. 15 is a view illustrating a photosensitive drum and a print head in an image forming apparatus according to a second embodiment.
Figure 16:
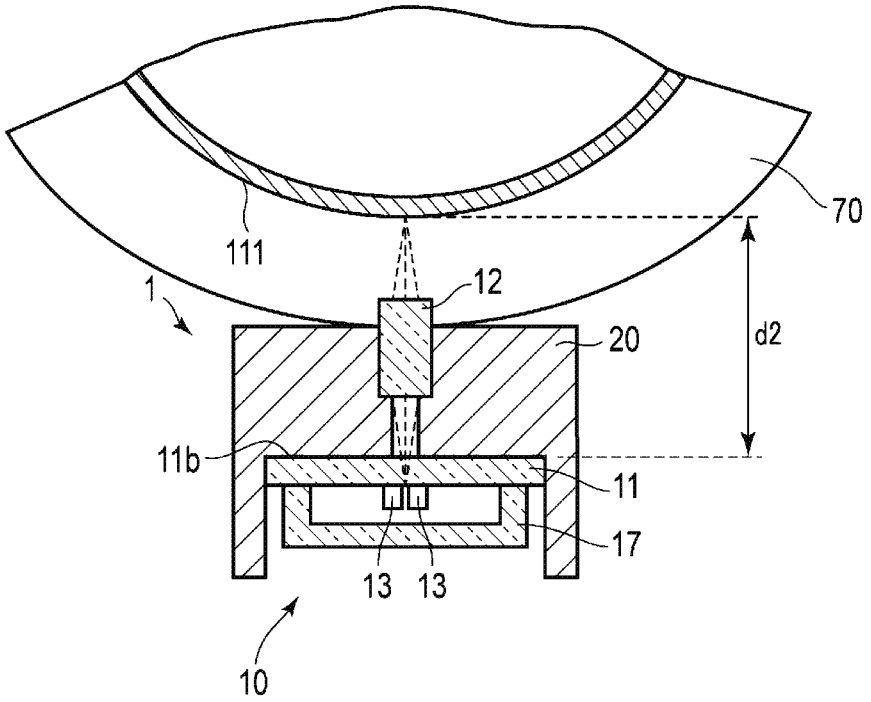
FIG. 16 is a cross sectional view of the photosensitive drum and the print head taken along the line E-E of FIG. 15.
Figure 17:
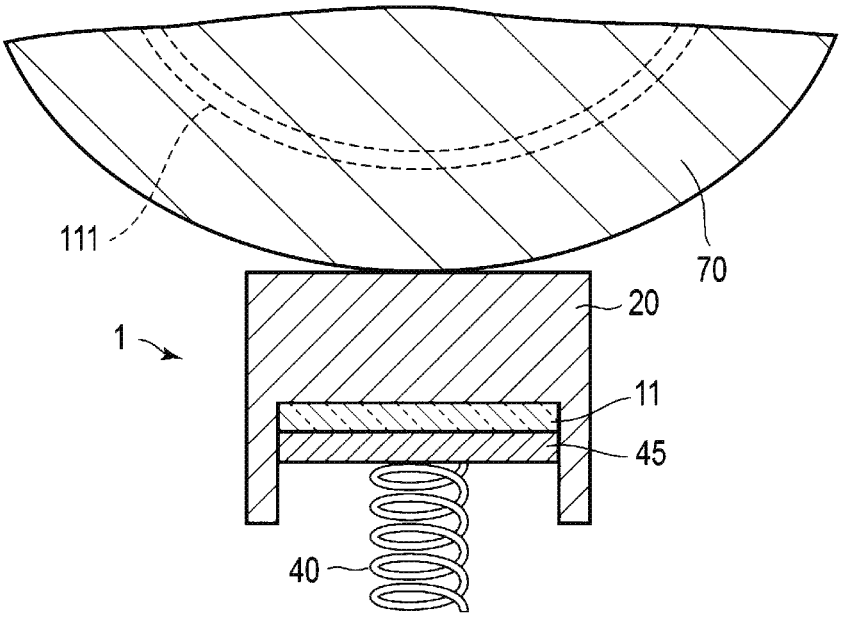
FIG. 17 is a cross sectional view taken along the line F-F of FIG. 15.

Hereinafter, an image forming apparatus 100B according to a second embodiment which is another example of the embodiment will be described with reference to FIGS. 15 to 17. Here, for convenience, a part of the image forming apparatus 100B, mainly, the photosensitive drum 111 and the print head 1 will be described with reference to FIGS. 15 to 17. FIG. 15 is a view illustrating the photosensitive drum 111 and the print head 1 in the image forming apparatus 100B according to the second embodiment. FIG. 16 is a cross sectional view of the photosensitive drum 111 and the print head 1 taken along the line E-E of FIG. 15. FIG. 17 is a cross sectional view of the photosensitive drum 111 and the print head 1 taken along the line F-F of FIG. 15. In FIGS. 15 to 17, members denoted by the same reference signs as those illustrated in FIGS. 5 to 7 are the same members, and the detailed description thereof will be omitted. Hereinafter, only the differences therebetween will be mainly described. In other words, parts not described in the following description are the same as those of the first embodiment.

The image forming apparatus 100B includes gap spacers 70 provided at opposite ends of the photosensitive drum 111. The gap spacer 70 has a disk shape and is provided coaxially with the photosensitive drum 111. For example, the gap spacer 70 is formed of a bearing and is rotatably mounted on a rotation shaft 111*a* of the photosensitive drum 111.

The biasing member 40 and the protection member 45 are aligned with the gap spacer 70. That is, the biasing member 40 and the protection member 45 are positioned on a straight line perpendicular to the rotation axis of the photosensitive drum 111 and passing through the gap spacer 70.

In the embodiment, the biasing member 40 biases the transparent substrate 11 toward the photosensitive drum 111 via the protection member 45. As a result, the whole print head 1 is biased toward the photosensitive drum 111. The gap spacers 70 are provided at the opposite ends of the photosensitive drum 111. The gap spacer 70 keeps a distance d2 between the outer surface 11*b* of the transparent substrate 11 and the photosensitive drum 111 constant by contacting the holder 20.

In the embodiment, by a simple configuration including the gap spacer 70, the biasing member 40, and the protection member 45, the light emitting element array 13 is disposed with high positional accuracy with respect to the photosensitive drum 111 on the basis of the outer surface 11*b* of the transparent substrate 11 as a reference. Since the gap spacer 70 is freely rotatable with respect to the photosensitive drum 111, a load on a support mechanism of the photosensitive drum 111 is reduced.

Third Embodiment

Figure 18:
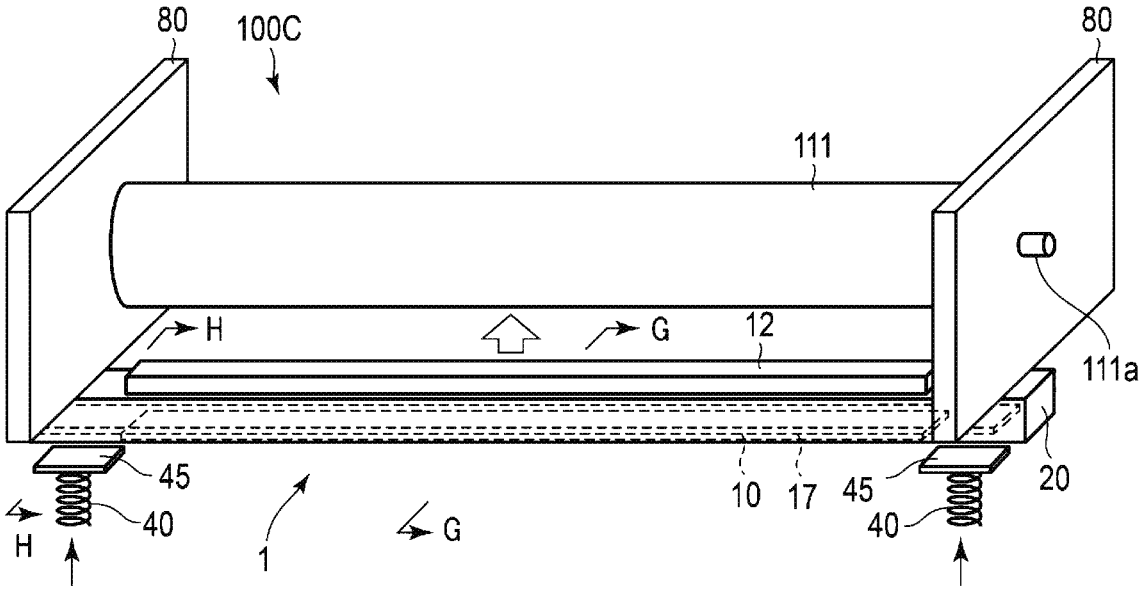
FIG. 18 is a view illustrating a photosensitive drum and a print head in an image forming apparatus according to a third embodiment.
Figure 19:
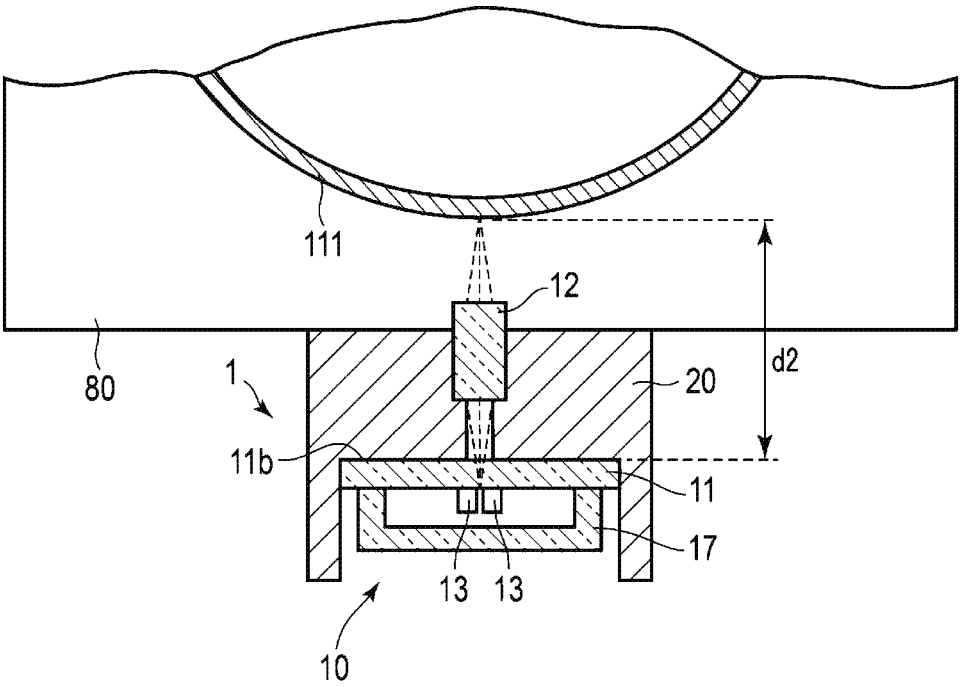
FIG. 19 is a cross sectional view of the photosensitive drum and the print head taken along the line G-G of FIG. 18.
Figure 20:
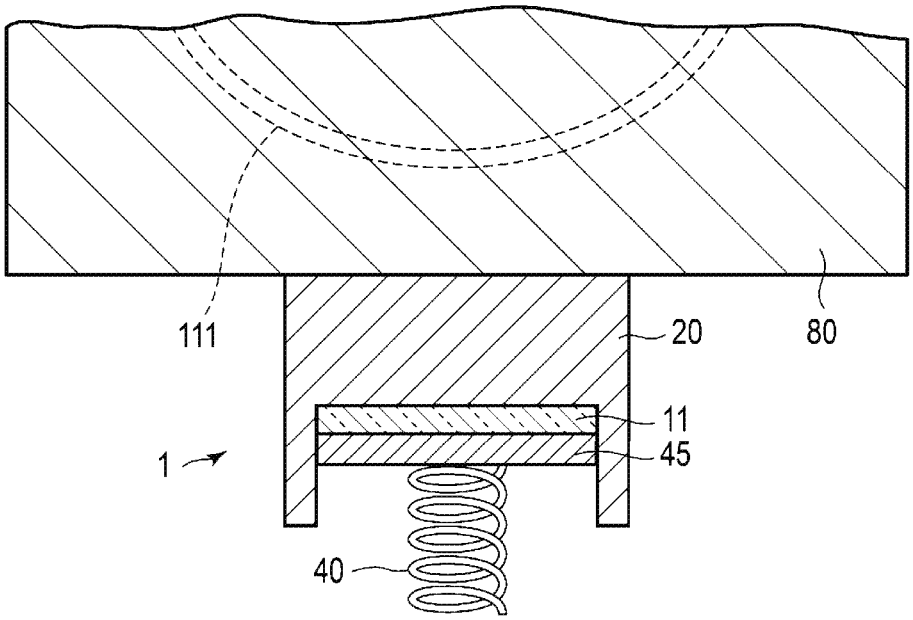
FIG. 20 is a cross sectional view taken along the line H-H of FIG. 18.

Hereinafter, an image forming apparatus 100C according to a third embodiment which is another example of the embodiment will be described with reference to FIGS. 18 to 20. Here, for convenience, a part of the image forming apparatus 100C, mainly, the photosensitive drum 111 and the print head 1 will be described with reference to FIGS. 18 to 20. FIG. 18 is a view illustrating the photosensitive drum 111 and the print head 1 in the image forming apparatus 100C according to the third embodiment. FIG. 19 is a cross sectional view of the photosensitive drum 111 and the print head 1 taken along the line G-G of FIG. 18. FIG. 20 is a cross sectional view of the photosensitive drum 111 and the print head 1 taken along the line H-H of FIG. 18. In FIGS. 18 to 20, members denoted by the same reference signs as those illustrated in FIGS. 5 to 7 are the same members, and the detailed description thereof will be omitted. Hereinafter, only the differences therebetween will be mainly described. In other words, parts not described in the following description are the same as those of the first embodiment.

The image forming apparatus 100C includes gap spacers 80 provided on opposite sides of the photosensitive drum 111 along the rotation axis of the photosensitive drum 111. For example, the gap spacer 80 is formed of a plate and is rotatably mounted on the rotation shaft 111*a* of the photosensitive drum 111.

The biasing member 40 and the protection member 45 are aligned with the gap spacer 80. That is, the biasing member 40 and the protection member 45 are positioned on a straight line perpendicular to the rotation axis of the photosensitive drum 111 and passing through the gap spacer 80.

In the embodiment, the biasing member 40 biases the transparent substrate 11 toward the photosensitive drum 111 via the protection member 45. As a result, the whole print head 1 is biased toward the photosensitive drum 111. The gap spacers 80 are provided on the opposite sides of the photosensitive drum 111. The gap spacer 80 keeps a distance d2 between the outer surface 11*b* of the transparent substrate 11 and the photosensitive drum 111 constant by contacting the holder 20.

In the embodiment, by a simple configuration including the gap spacer 80, the biasing member 40, and the protection member 45, the light emitting element array 13 is disposed with high positional accuracy with respect to the photosensitive drum 111 on the basis of the outer surface 11*b* of the transparent substrate 11 as a reference.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a light emitting element array that includes a plurality of light emitting elements;

a photosensitive member that forms a latent image by being exposed to light emitted from the light emitting element array;

a transparent member that is positioned between the photosensitive member and the light emitting element array, has a relative position fixed with respect to the light emitting element array, and transmits the light emitted from the light emitting element array;

a gap spacer configured to maintain a constant distance between the photosensitive member and the transparent member; and a biasing member configured to bias the transparent member toward the photosensitive member, wherein the transparent member, the gap spacer, and the biasing member are positioned on a straight line.

2. The image forming apparatus of claim 1, wherein the transparent member is a transparent substrate on which the light emitting element array is formed.

3. The image forming apparatus of claim 2, further comprising:

a lens that is disposed between the light emitting element array and the photosensitive member, and that is configured to condense the light emitted from the light emitting element array on the photosensitive member; and a holder coupled to the lens and the transparent substrate, wherein the gap spacer is positioned between the photosensitive member and the holder and is configured to maintain the constant distance between (a) a surface of the transparent substrate positioned on the opposite side to a surface of the transparent substrate on which the light emitting element array is formed and (b) the photosensitive member by contacting the photosensitive member and the holder.

4. The image forming apparatus of claim 3, wherein the gap spacer includes a cylindrical surface facing the photosensitive member, and wherein a radius of curvature of the cylindrical surface is equal to or smaller than a radius of curvature of the photosensitive member.

5. The image forming apparatus of claim 2, further comprising:

a protection member that is disposed between the transparent substrate and the biasing member, and that is configured to protect the transparent substrate from force applied by the biasing member.

6. The image forming apparatus of claim 2, further comprising:

a lens that is disposed between the light emitting element array and the photosensitive member, and that is configured to condense the light emitted from the light emitting element array on the photosensitive member; and a holder coupled to the lens and the transparent substrate, wherein the gap spacer includes a pair of bearings, each bearing provided at an opposite end of the photosensitive member; and wherein each bearing has a disk shape, is provided coaxially with the photosensitive member, and is configured to maintain the constant distance between (a) a surface of the transparent substrate positioned on the opposite side to a surface of the transparent substrate on which the light emitting element array is formed and (b) the photosensitive member by contacting the holder.

7. The image forming apparatus of claim 2, further comprising:

a lens that is disposed between the light emitting element array and the photosensitive member, and that is configured to condense the light emitted from the light emitting element array on the photosensitive member; and a holder coupled to the lens and the transparent substrate, wherein the gap spacer includes a pair of plates provided on opposite sides of the photosensitive member; and wherein the plates are rotatable with respect to the photosensitive member and are configured to maintain the constant distance between (a) a surface of the transparent substrate positioned on the opposite side to a surface of the transparent substrate on which the light emitting element array is formed and (b) the photosensitive member by contacting the holder.

8. The image forming apparatus of claim 1, further comprising:

a transparent substrate on which the light emitting element array is formed, wherein the transparent member is a transparent cover that cooperates with the transparent substrate to seal the light emitting element array.

9. The image forming apparatus of claim 1, wherein the light emitting element array is a first light emitting element array, wherein the light emitting elements are first light emitting elements, further comprising a second light emitting element array that includes a plurality of second light emitting elements, wherein the photosensitive member is a photosensitive roller configured to rotate such that a surface of the photosensitive member moves in a sub-scanning direction;

wherein the first lighting elements are arranged in a first row extending in a main scanning direction that is orthogonal to the sub-scanning direction;

wherein the second lighting elements are arranged in a second row offset from the first row; and wherein the first lighting element positioned closest to an end of the photosensitive roller is offset in the main scanning direction from the second lighting element positioned closest to the end of the photosensitive roller.

10. The image forming apparatus of claim 1, wherein the photosensitive member is a photosensitive drum configured to rotate about a rotation axis, and wherein the straight line is perpendicular to the axis of rotation.

11. A print head for an image forming apparatus, comprising:

a light emitting element array that includes a plurality of light emitting elements configured to emit light that forms a latent image on a photosensitive member;

a transparent member that is positioned between the photosensitive member and the light emitting element array, has a relative position fixed with respect to the light emitting element array, and transmits the light emitted from the light emitting element array;

a holder fixedly coupled to the transparent member;

a gap spacer configured to engage both the holder and the photosensitive member to maintain a constant distance between the photosensitive member and the transparent members and a biasing member configured to apply a biasing force to bias the holder toward the photosensitive member, wherein the transparent member extends between the biasing member and the gap spacer such that the biasing member applies the biasing force through the transparent member.

12. The print head of claim 11, further comprising a lens that is coupled to the holder and configured to condense the light emitted from the light emitting element array on the photosensitive member, wherein the holder defines a slit positioned such that at least a portion of the light emitted from the light emitting element array passes through the slit and into the lens.

13. The print head of claim 11, further comprising a protection member extending between the biasing member and the transparent member such that the biasing member applies the biasing force to the holder through the protection member and the transparent member.

14. The print head of claim 13, wherein the transparent member is a transparent substrate on which the light emitting element array is formed;

wherein the protection member has a first surface that engages the holder and a second surface that engages the transparent substrate, and wherein the first surface is offset from the second surface.

15. An image forming apparatus, comprising:

a light emitting element array that includes a plurality of light emitting elements fixedly coupled to a transparent substrate;

a photosensitive member that forms a latent image by being exposed to light emitted from the light emitting element array;

a lens that is disposed between the light emitting element array and the photosensitive member, and that is configured to condense the light emitted from the light emitting element array on the photosensitive member;

a holder fixedly coupled to the lens and the light emitting element;

a gap spacer configured to maintain a constant distance between the photosensitive member and the light emitting element array; and a biasing member configured to bias the transparent substrate toward the photosensitive member, wherein the biasing member, the gap spacer, and the transparent substrate are aligned.

16. The image forming apparatus of claim 15, wherein the gap spacer is fixedly coupled to the holder and configured to engage the photosensitive member to maintain the constant distance between the photosensitive member and the light emitting element array.

17. The image forming apparatus of claim 16, wherein the photosensitive member is a photosensitive roller, wherein the gap spacer includes a concave cylindrical surface facing the photosensitive roller, and wherein a radius of curvature of the concave cylindrical surface is equal to or smaller than a radius of curvature of the photosensitive roller.

18. The image forming apparatus of claim 15, wherein the gap spacer includes a pair of bearings, each bearing provided at an opposite end of the photosensitive member, wherein each bearing has a disk shape, is provided coaxially with the photosensitive member, and is configured to engage the holder to maintain the constant distance between the photosensitive member and the light emitting element array.

19. The image forming apparatus of claim 15, wherein the gap spacer includes a roller rotatably coupled to the holder and configured to engage the photosensitive member to maintain the constant distance between the photosensitive member and the light emitting element array, and wherein the roller is at least one of spherical or cylindrical.

20. The image forming apparatus of claim 15, wherein the transparent substrate extends between the light emitting elements and the photosensitive member.

* * * * *